United States Patent [19]

Tanokura

[11] 4,307,766

[45] Dec. 29, 1981

[54] PLASTIC CONTAINER FOR MEDICAL LIQUID

[75] Inventor: Nobukazu Tanokura, Fujinomiya, Japan

[73] Assignee: Terumo Corporation, Tokyo, Japan

[21] Appl. No.: 149,857

[22] Filed: May 14, 1980

[30] Foreign Application Priority Data

May 18, 1979 [JP] Japan ..... 54-65594[U]

[51] Int. Cl.[3] ..... B65D 33/16

[52] U.S. Cl. ..... 150/8; 215/247; 215/1 C; 128/214 D; 128/272

[58] Field of Search ..... 215/247, 248, 249, 1 C; 150/0.5, 8; 128/272, 272.3, 214 D, 214 C

[56] References Cited

U.S. PATENT DOCUMENTS

| | | | |
|---|---|---|---|
| 3,030,955 | 4/1962 | Gossett et al. | 150/8 X |
| 3,900,028 | 8/1975 | McPhee | 128/272 |
| 4,084,718 | 4/1978 | Wadsworth | 215/247 |
| 4,187,893 | 2/1980 | Bujan | 215/247 X |

*Primary Examiner*—George T. Hall

*Attorney, Agent, or Firm*—Frishauf, Holtz, Goodman and Woodward

[57] ABSTRACT

A plastic container for medical liquid has an improved mouth portion for the admission or withdrawal of a medical liquid. The mouth portion is characterized by comprising (i) a rigid plastic cylindrical body, one end of which communicates with the inside of the container and the other end of which is enlarged in diameter; (ii) a rubber stopper body inserted in the enlarged end of the mouth portion; (iii) an annular rigid plastic stopper holding member which is attached to the upper edge of the enlarged end of the mouth portion and whose inner peripheral portion presses the upper surface of the peripheral portion of the rubber stopper body; and (iv) a water-impermeable soft sealing member interposed between the bottom of the rubber stopper body and the bottom of the enlarged end of the mouth portion.

8 Claims, 3 Drawing Figures

PLASTIC CONTAINER FOR MEDICAL LIQUID

BACKGROUND OF THE INVENTION

The present invention relates to a plastic container for medical liquid such as a transfusing liquid bag, and especially, to an improvement of its mouth portion.

In a conventional plastic container for medical liquid, a mouth portion for pouring or withdrawing the medical liquid from the container is so constructed that one end communicates with the inside of the container, the other end extends outside the container, a soft plastic tube is attached to the container, and a rubber stopper is inserted in the outer end of the tube or the outer end of the tube is covered with a rubber stopper.

However, a mouth portion of such a conventional construction is made entirely of soft material. Thus, in inserting a metal cannula, the cannula may pierce the container in the wrong place. Therefore, the cannula used is limited to plastic cannulas. Further, even when plastic cannulas are used, distortions may be caused between the rubber stopper and the mouth portion due to the pressure of the cannula. Due to this, the solution in the container may leak. Liquid leakage may still occur if the rubber stopper cannot function adequately to prevent leakage through the hole after the cannula is pulled out. Further, the mouth portion is small in shape and thus inconvenient to handle, and special care must be taken when inserting the cannula. The conventional mouth of a container of this type is thus unsatisfactory.

The present invention has been made to overcome these problems and has for its object to provide a plastic container for medical liquid which has a mouth portion which prevents liquid leakage when the container is pierced with a cannula and after the cannula is pulled out, and with which the insertion of a metal or plastic cannula is extremely easy.

SUMMARY OF THE INVENTION

Thus, the present invention provides a plastic container for medical liquid which has a container body and a mouth portion for admission and withdrawal of a medical liquid characterized in that the mouth portion comprises (a) a rigid plastic cylindrical body at one end of which the base portion is liquid-tightly joined to the container and at the other end of which the inner diameter portion is enlarged; (b) a rubber stopper inserted in the enlarged inner diameter portion; (c) a rigid plastic stopper holding member which comprises an annular plate body, whose inner peripheral portion is formed on the rubber stopper so as to overlap the peripheral portion of the rubber stopper body, and whose outer peripheral portion is liquid-tightly adhered to the enlarged diameter end of the plastic cylindrical body; and (d) a soft sealing member which is interposed between the bottom of the rubber stopper body and the bottom of the enlarged inner diameter portion and which prevents contact between the bottom of the rubber stopper body and the channel of the cylindrical body.

In accordance with another preferred embodiment of the present invention, a plastic container for medical liquid is characterized in that an annular groove is formed around the upper surface of the rubber stopper body, an annular projection is formed on the inner periphery of the stopper holding member for fitting into the annular groove of the rubber stopper body; and the rubber stopper and the stopper holding member engage each other by the annular projection fitting into the annular groove.

BRIEF DESCRIPTION OF THE DRAWINGS

This invention can be more fully understood from the following detailed description when taken in conjunction with the accompanying drawings, in which.

DETAILED DESCRIPTION

Figure 1:
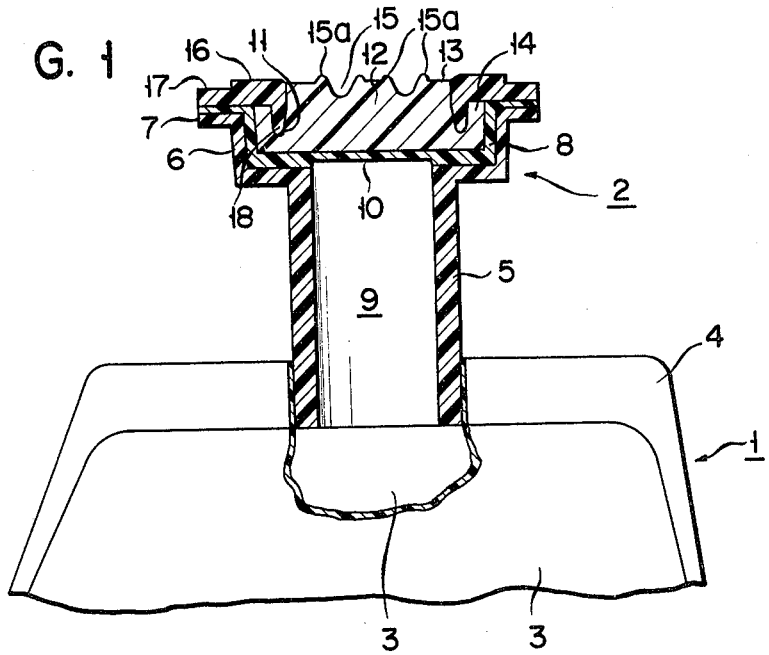
FIG. 1 is a partially cut away, schematic sectional view of a plastic container for medical liquid in accordance with the present invention.

FIG. 1 is partially cut away for the sake of simplicity and shows a plastic container for medical liquid which comprises a container body 1 for containing a medical liquid such as isotonic sodium chloride solution or a solution for injections, and a mouth portion 2 extending from the periphery of the body for admission and withdrawal of the medical liquid. The container 1 comprises two soft plastic sheets 3 of, for example, vinyl chloride resin, and a bag is formed by sealing (e.g. high frequency or ultrasonic frequency sealing) its peripheral portion 4 for water impermeability (excluding the inlet of the mouth portion 2). One end of a cylindrical body 5 of rigid vinyl chloride resin with both ends open is clamped between the pair of soft plastic sheets 3 to be sealed at the inlet of the peripheral portion 4 (sealed portion). A large diameter portion 6 is formed at the other end of the cylindrical body 5, and an outwardly extending collar 7 is formed at the top end of the large diameter portion 6.

Figure 2:
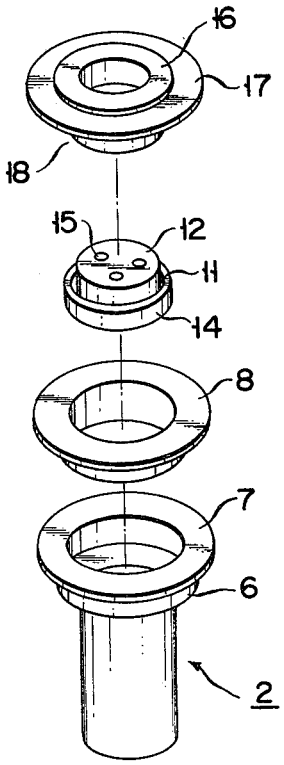
FIG. 2 is an exploded perspective view of the mouth portion of the container shown in FIG. 1.

As seen from FIG. 2, on the top surface of the cylindrical body 5 is adhered a dish-shaped sealing member 8 which is designed to fit with the large diameter portion 6 and with the collar 7. The dish-shaped sealing member 8 is made of a soft plastic material such as soft vinyl chloride, and a center portion 10 corresponding to a liquid flow channel 9 of the cylindrical body 5 is made thin so as to be easily pierced with a cannula (not shown). A rubber stopper 12 with an annular groove 11 along its upper peripheral surface fits into a recess on the top surface of the sealing member 8. A top surface 13 at the inner side of the annular groove 11 of the stopper 12 protrudes relative to a side portion 14 outside the annular groove 11, and a plurality of recesses 15 are formed indicating parts to be pierced when withdrawing or mixing injection solutions. An annular projection 15*a* is formed around each recess 15 so that the medicinal solution will not be transferred to another recess 15 when the needle is pulled out of the rubber stopper 12.

An annular stopper holding member 16 is formed on the top surface of the peripheral portion of the stopper 12, which is liquid-tightly joined to the collar 7 of the cylindrical body 5 when the stopper 12 is pressed and secured to the sealing member 8. The stopper holding member 16 is made of a rigid plastic material such as rigid vinyl chloride, and it has a collar portion 17 at its outer periphery. An annular projection 18 of wedge-shaped vertical sectional area to fit into the annular groove 11 of the rubber stopper body 12 extends downward from the inner periphery of the holding member 16. When the annular projection 18 is fitted into the annular groove 11, the outside portion 14 of the stopper 12 is pressed toward the recessed inner wall or the bottom of the sealing member 8, and the collar portion 17 and the collar 7 of the cylindrical body 5 are joined together through the periphery of the sealing member 8. Methods for adhering these portions are not particularly limited, but high frequency or ultrasonic frequency heat sealing is generally utilized.

With a mouth portion of the above construction, the sealing member 8 is at the lower surface of the rubber stopper body 12. Thus the medical liquid in the container body 1 will not contact the rubber stopper body, so that dissolving of the rubber component is prevented. Leakage of the medical liquid due to distortions in the periphery of the rubber stopper body 12 when the cannula is inserted or withdrawn is prevented. This is because this part of the periphery is securely held by the rigid plastic material of the annular projection 18 of the stopper holding member 16 and the large diameter portion 6 of the cylindrical body 5. Further, since the cylindrical body 5 of the mouth portion is made of a rigid plastic material, erroneous piercing of the cannula to the outside of the mouth portion is prevented, regardless of whether a plastic cannula or a metal cannula is used. Further, the handling involved in inserting the cannula is extremely easy since the top end of the mouth portion is generally large due to the presence of the large diameter portion 6, the collar portion 7, and so on of the cylindrical body.

Figure 3:
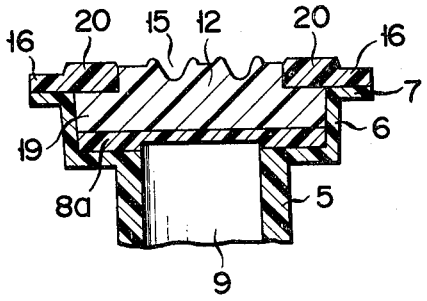
FIG. 3 is a sectional view illustrating another embodiment of the mouth portion of the plastic container for medical liquid in accordance with the present invention.

In the above embodiment, a dish-shaped sealing member was integrally formed so as to prevent contact between the rubber stopper body 12 and the medicinal solution in the container body 1 and to act as a medium of attachment between the stopper holding member 16 and the collar 7 of the cylindrical body 5. However, the present invention is not limited to this construction. For example, as shown in FIG. 3, a disk-shaped sealing member 8*a* may be used. An attaching medium (for example, an adhesive) may or may not be interposed between the stopper holding member 16 and the collar 7 for sealing effects. Further, although the sealing between the stopper holding member 16 and the large diameter portion 6 of the cylindrical body 5 was accomplished by the collar 7 of the large diameter portion 6, this collar 7 may be eliminated and the holding member 16 may be directly adhered to the large diameter portion 6.

Further, in the embodiment shown in FIGS. 1 and 2, water-impermeability between the stopper holding member 16 and the rubber stopper body 12 was achieved by fitting the annular projection 18 into the annular groove 11. However, this fitting of the annular projection into the annular groove may be eliminated as shown in FIG. 3 and the inner peripheral portion 20 of the stopper holding member 16 may be pressed downward against the outer peripheral portion 19 of the rubber stopper body 12.

Rigid plastic materials which may be used for the cylindrical body 5 and the stopper holding member 16 include rigid vinyl chloride resin, as mentioned earlier, and other relatively rigid and heat-resistant (for sterilization) materials such as rigid polyethylene, polycarbonate, polypropylene and so on. Soft plastic materials which may be used for the sealing member at the bottom of the stopper 12 include soft vinyl chloride resin, as mentioned earlier, polyethylene, polyester resin, urethane resin, ethylene-vinylacetate copolymer, any elastic plastic foam with air bubbles, and so on. The rubber material to be used for the stopper 12 may be the known material which is in general used as a rubber stopper for cannula insertion. The shape and material of the container body 1 is not limited and can be arbitrarily selected, as long as it is capable of being sealed to the cylindrical body 5. The number of mouth portions formed on the container body 1 is not limited, either. The material of the container body 1 may be a flexible soft plastic such as an ethylene-vinylacetate copolymer (EVA) in place of polyvinyl chloride. Ethylene-vinylacetate copolymer of a higher gelation rate (intermolecular crosslinking ratio) is preferable. Such an EVA is disclosed in U.S. Pat. No. 3,160,575 and German Pat. No. p 2800484.4.

What is claimed is:

1. A plastic container for medical liquid having a plastic container body and a mouth portion for admission and withdrawal of a medical liquid characterized in that said mouth portion comprises (a) a rigid plastic cylindrical body whose base portion is water-impermeably joined to said container body at one end and which has an enlarged inner diameter portion at the other end; (b) a rubber stopper body inserted in said enlarged inner diameter portion; (c) a rigid plastic stopper holding member which comprises an annular plate body, whose inner peripheral portion is formed on said rubber stopper body so as to overlap the peripheral portion of said rubber stopper body, and whose outer peripheral portion is water-impermeably adhered to the top end of said plastic cylindrical body; and (d) a soft sealing member which is interposed between the bottom of said rubber stopper body and the bottom of said enlarged inner diameter portion and which prevents contact between the bottom of said rubber stopper body and a channel of said cylindrical body.

2. The plastic container for medical liquid as claimed in claim 1 further characterized in that an annular groove is formed along the upper peripheral surface of said rubber stopper body, an annular projection is formed on the inner periphery of said stopper holding member for fitting into said annular groove of said rubber stopper body; and said rubber stopper body and said stopper holding member engage each other due to the fitting of said annular groove and said annular projection.

3. The plastic container for medical liquid as claimed in claim 1 or 2 wherein a plurality of recesses representative of positions to be pierced by a cannula are formed on the top surface of said rubber stopper body.

4. The plastic container for medical liquid as claimed in claim 3 wherein an annular projection is formed around the edge of each of said recesses.

5. The plastic container for medical liquid as claimed in claim 1 or 2 wherein said enlarged inner diameter end of said rigid plastic cylindrical body and the outer peripheral region of said rigid plastic stopper holding member are joined together and sealed.

6. The plastic container for medical liquid as claimed in claim 1 or 2 wherein said plastic container body consists of soft polyvinyl chloride or an ethylene-vinylacetate copolymer.

7. The plastic container for medical liquid as claimed in claim 1 or 2 wherein said stopper holding member and said cylindrical body consist of a material selected from the group consisting of rigid vinyl chloride resin, rigid polyethylene, polycarbonate and polypropylene.

8. The plastic container for medical liquid as claimed in claim 1 or 2 wherein said soft sealing member consists of a material selected from the group consisting of soft vinyl chloride resin, polyethylene, polyester resin, urethane resin, ethylene-vinylacetate copolymer, and an elastic plastic foam.

* * * * *

UNITED STATES PATENT AND TRADEMARK OFFICE

CERTIFICATE OF CORRECTION

PATENT NO. : 4,307,766

DATED : December 29, 1981

INVENTOR(S) : Nobukazu TANOKURA

It is certified that error appears in the above—identified patent and that said Letters Patent is hereby corrected as shown below:

Column 4, line 56, "consists of soft polyvinyl chloride or" should read --is made of one of soft polyvinyl chloride and--;

Column 4, line 59, "cylindrical body consist" should read --cylindrical body are made--;

Column 4, line 63, "member consists" should read --member are made--.

Signed and Sealed this

*Twenty-seventh* Day of *July 1982*

[SEAL]

*Attest:*

GERALD J. MOSSINGHOFF

*Attesting Officer*

*Commissioner of Patents and Trademarks*